US007547470B2

(12) United States Patent
Gardner et al.

(10) Patent No.: US 7,547,470 B2
(45) Date of Patent: Jun. 16, 2009

(54) MULTIFUNCTIONAL REINFORCEMENT SYSTEM FOR WOOD COMPOSITE PANELS

(75) Inventors: Douglas J. Gardner, Brewer, ME (US); Stephen M. Shaler, Veazie, ME (US); Lech Muszynski, Corvallis, OR (US); Ciprian Pirvu, Richmond (CA); Jungil Son, Gunpo-Shi (KR)

(73) Assignee: University of Maine System Board of Trustees, Bangor, ME (US)

( * ) Notice: Subject to any disclaimer, the term of this patent is extended or adjusted under 35 U.S.C. 154(b) by 435 days.

(21) Appl. No.: 11/414,143

(22) Filed: Apr. 28, 2006

(65) Prior Publication Data

US 2006/0263618 A1 Nov. 23, 2006

Related U.S. Application Data

(60) Provisional application No. 60/676,401, filed on Apr. 29, 2005.

(51) Int. Cl.

| | |
|---|---|
| ***B32B 23/02*** | (2006.01) |
| ***B32B 7/02*** | (2006.01) |
| ***B32B 27/32*** | (2006.01) |
| ***B32B 27/06*** | (2006.01) |

(52) U.S. Cl. ..... 428/192; 428/212; 428/220; 428/411.1; 428/430; 428/480; 428/503; 52/309.1; 52/309.7

(58) Field of Classification Search ..... 428/195.1, 428/212, 357, 395, 403, 411.1, 426, 430, 428/480, 503; 52/309.7, 309.8

See application file for complete search history.

(56) References Cited

U.S. PATENT DOCUMENTS

| | | | | |
|---|---|---|---|---|
| 2,694,648 | A | 11/1954 | Muench | |
| 2,702,761 | A | 2/1955 | Mannheim | |
| 2,745,129 | A | 5/1956 | Johnson | |
| 3,081,213 | A | 3/1963 | Chinn | |
| 3,466,264 | A * | 9/1969 | Gleason et al. | 528/283 |
| 3,595,203 | A | 7/1971 | Fabulich | |
| 3,967,581 | A | 7/1976 | Zirbel | |
| 3,994,765 | A | 11/1976 | Brinkmann et al. | |
| 4,226,662 | A | 10/1980 | McCort | |
| 4,497,918 | A * | 2/1985 | Wason | 523/220 |

(Continued)

FOREIGN PATENT DOCUMENTS

WO WO94/23916 10/1994

OTHER PUBLICATIONS

American Society for Testing and Materials. 1998. Standard test methods for evaluating properties of wood-base fiber and particle panel materials. ASTM D 1037-96a.

(Continued)

*Primary Examiner*—Jennifer McNeil
*Assistant Examiner*—Lawrence D Ferguson
(74) *Attorney, Agent, or Firm*—MacMillan, Sobanski & Todd, LLC

(57) ABSTRACT

A moisture impermeable edge reinforced wood composite structural system includes a wood composite panel having opposing faces, at least one moisture impermeable reinforcement edge, and at least one moisture impermeable reinforcement perimeter zone. The perimeter zone is a coating of a moisture impermeable reinforcement/resin matrix material which provides the structural system with improved fastener performance and reduced panel edge swell as a result of moisture exposure.

16 Claims, 16 Drawing Sheets

U.S. PATENT DOCUMENTS

| | | | |
|---|---|---|---|
| 5,106,666 | A | 4/1992 | Fitzgerald et al. |
| 5,135,793 | A | 8/1992 | Socha |
| 5,153,058 | A | 10/1992 | Hall et al. |
| 5,275,862 | A | 1/1994 | Ramadan et al. |
| 5,373,036 | A | 12/1994 | Parish et al. |
| 5,391,340 | A | 2/1995 | Mirous et al. |
| 5,565,257 | A | 10/1996 | Tingley |
| 5,648,138 | A | 7/1997 | Tingley |
| 5,721,036 | A | 2/1998 | Tingley |
| 5,744,228 | A | 4/1998 | Tingley |
| 5,747,151 | A | 5/1998 | Tingley |
| 5,885,685 | A | 3/1999 | Tingley |
| 5,910,352 | A | 6/1999 | Tingley |
| 6,037,049 | A | 3/2000 | Tingley |
| 6,051,301 | A | 4/2000 | Tingley |
| 6,145,260 | A | 11/2000 | Morton |
| 6,265,027 | B1 | 7/2001 | Johnston et al. |
| 6,281,148 | B1 | 8/2001 | Dagher et al. |
| 6,303,207 | B1 | 10/2001 | Kajander |
| 6,331,339 | B1 | 12/2001 | Kajander |
| 6,352,784 | B1 | 3/2002 | Katagiri |
| 6,463,871 | B1 | 10/2002 | Anderson et al. |
| 6,490,834 | B1 | 12/2002 | Dagher |
| 6,558,765 | B2 | 5/2003 | Padmanabhan |
| 6,558,766 | B2 | 5/2003 | Padmanabhan et al. |
| 6,584,742 | B1 * | 7/2003 | Kligler et al. ..... 52/309.7 |
| 6,592,962 | B2 | 7/2003 | Edwards et al. |
| 6,596,408 | B1 | 7/2003 | Endoh et al. |
| 6,608,131 | B1 | 8/2003 | Winterowd et al. |
| 6,699,575 | B1 | 3/2004 | Dagher et al. |
| 6,749,921 | B1 | 6/2004 | Edwards et al. |
| 7,083,696 | B2 * | 8/2006 | Meuwissen et al. ..... 156/166 |
| 2002/0122954 | A1 | 9/2002 | Dagher |
| 2003/0143373 | A1 | 7/2003 | Bledsoe et al. |
| 2004/0013857 | A1 | 1/2004 | Winterowd et al. |

OTHER PUBLICATIONS

American Society for Testing and Materials. 1998. Standard Test Methods for Mechanical Fasteners in Wood. ASTM D 1761-88.

American Society for Testing and Materials. 1998. Standard test method for determination of edge performance of composite wood products under surfactant accelerated moisture stress. ASTM D 2065-96.

American Society for Testing and Materials. 1998. Stnadard practice for Static Load Test for Shear Resistance of Framed Walls for Buildings. ASTM E 564-95. Annual Book of Standards vol. 4.11.

Krawinkler, H., Parisi, F., Ibarra, L., Ayoub, A. and Medina, R, (2000). "Development of a Testing Protocol for Wood-Frame Structures." CUREE Publication No. W-02, Consortium of Universities of Research in Earthquake Engineering, Richmond, CA.

* cited by examiner

MULTIFUNCTIONAL REINFORCEMENT SYSTEM FOR WOOD COMPOSITE PANELS

This work was sponsored by the Office of Naval Research under Contract N00014-00-C-0488.

TECHNICAL FIELD

This invention relates to a multifunctional reinforcement system for wood composite panels.

BACKGROUND OF THE INVENTION

This invention relates in general to strengthening wood-frame construction, and in particular, to a method of strengthening wood-frame construction and increase its resistance to high wind, earthquake or blast loadings by applying a reinforcement matrix comprising a resin and fibers to the panels.

A very common wood frame construction method uses wood or steel studs or wood or steel framing with plywood or Oriented Strand Board (OSB) sheathing panels or stucco sheathing. The framing/sheathing combination forms shear walls and horizontal diaphragms which resist horizontal and vertical loads applied to the structure. This form of construction is used in the majority of single family homes in North America, as well as a significant portion of multi-family, commercial and industrial facilities.

Wood composites comprised oriented strandboard (OSB) panels are increasing in popularity in traditional applications such as sheathing for roofs and walls, subfloors and floors. However, while OSB has become the dominant wood based sheathing material used in construction over the last 20 years, displacing plywood, the OSB has certain disadvantages, such as high vulnerability to thickness swelling and water absorption.

While the system has generally performed well, the economic losses in the United States due to natural disasters, such as hurricanes, earthquakes and tornadoes, have been mounting. The economic losses caused by these natural disasters in the United States have averaged about $1 billion/week in recent years. Most of these losses are due to hurricanes (80%) and earthquakes (10%). For example, loss of roof sheathing under hurricane winds has often been attributed to improper fastening of the sheathing to the framing, such as by the use of larger nail spacing than allowed by code, nails missing the support framing members, or over-driven nails. Loss of sheathing in hurricanes weakens the roof structure and can lead to roof failures. The water damage resulting from a loss of roof sheathing or roof failures has been a major contributor to economic losses in hurricanes. Surveys also show that a significant portion of the damage resulting from hurricanes or earthquakes occurs in nonstructural parts of the home due to excessive deformation or movements of the structure. The cost to repair nonstructural damage often makes it necessary to rebuild the structure rather than to repair it.

While the knowledge to mitigate hurricane and earthquake damage exists today, building code provisions are often misunderstood by builders, and compliance with regulations is difficult to enforce because of the difficulty of inspecting in the field. As a result, surveys show that a significant portion of the damage to homes and property caused by natural disasters is due to lack of conformance to codes. Improper connections between walls at building corners, such as non-overlapping top plates or improper or missing hold-downs to tie the shear walls to the foundations, are further examples of poor construction practices that are difficult to inspect.

Therefore, there is a need for a simple, easy-to-inspect, inexpensive construction method to strengthen and stiffen conventional construction for improved performance against hurricane and earthquake damage. The construction method should increase the strength and ductility of wood buildings and reduce the deformation of the buildings to limit damage to non-structural members.

In particular, many timber structures are situated in coastal areas that are continuously exposed to strong winds, salty and humid environments. Many factors in the environment, particularly water and temperature, as well as wind, earthquakes, insects, and fire affect timber structures. The most important factor leading to wood degradation and joint failures is, however, moisture. Moisture may penetrate the building envelope and then infiltrate into the fissures or micro-cracks existent in structural panels causing the system to deteriorate gradually.

It is, therefore, important that a building envelope provide a rain screen to prevent rain infiltration. It is desired that the building envelope be a continuous barrier in order to inhibit air leakage and to prevent the movement of moisture between the interior and exterior. It is important that the exterior building barrier is impermeable, or less penetrable, to the passage of moisture than the interior barrier. Moreover, the interior building barrier needs to provide a semi-permeable reinforcement, to allow the escape of moisture that has bypassed the inner barrier.

A common problem in the application of structural panels is durability of the connection zones subjected to load, mechanical wear and climate exposure. In particular, moisture uptake at the panel edges inflicts dimensional instability and deterioration of the material, which in turn causes connection failure.

Another problem that arises is the exposure of panels and connectors to moisture during the construction process. It is therefore desired to develop panels and connectors that will have improved dimensional stability and connector durability during the construction phase.

One potential method of protection against moisture penetration and increasing system durability of wood composites is application of coatings and/or reinforcements. In addition to moisture resistance, an effective edge protection system also offers reinforcement promoting dimensional stability and connector durability.

In the past coatings and/or reinforcements have been applied on the entire surface of a wood composite (i.e., covering the entire faces and edges), sealing the wood composite completely. However, perfectly sealed system is not easy to produce, but is expensive to manufacture, and is difficult to maintain. One disadvantage is that even a small discontinuity in such coating/sealing (a check or scratch through the protective layer) may allow moisture to accumulate inside the composite, and if such moisture is trapped inside the composite with no way out, over time the moisture destroys the composite.

U.S. Pat. No. 6,390,834 to Dagher and U.S. Pat. No. 6,699,575 to Dagher et al., which are owned by the same assignee as herein, describe applying fiber reinforced polymer strips to a wood sheathing panels used to build a structure or building to enhance the resistance of the structure to earthquakes and high winds from hurricanes and tornadoes.

It would be advantageous if there could be developed an improved system for improving the durability of a building system is by increasing the moisture resistance of its components (e.g., wood composites).

SUMMARY OF THE INVENTION

In one aspect, a multi-functional reinforcement system includes a wood composite panel that has moisture impermeable reinforcements on a panel perimeter zone. The waterproof edge reinforcements control thickness swelling while the face reinforcement zones on the panel perimeter improve connector resistance in the panels.

The multi-functional reinforcement system enhances the environmental durability and improves the mechanical properties of commercially available wood composites, including in particular, oriented strandboard (OSB).

In another aspect, the reinforcement system provides improved dimensional stability, especially through the thickness of the material to wood composites.

In another aspect, the reinforcement system also provides superior connector performance for wood composites; and, in particular, for use in structural applications.

The reinforcement system has improved panel-to-framing connector performance in shear walls and diaphragms utilizing plywood or OSB panels. The improved connector performance also provides greater shear wall, or diaphragm, strength and energy absorption under lateral loads due to stresses such as, for example, earthquakes and major wind events.

In another aspect, a moisture impermeable edge reinforced wood composite structural system includes a wood composite panel having edges coated with a fiber/resin matrix material. The composite structural system has improved fastener performance and reduced panel edge swell as a result of moisture exposure. In certain embodiments, the fiber/resin matrix comprises at least one of polyester (PE) and vinyl ester (VE).

In certain embodiments, the fiber/resin matrix comprises at least one of light woven glass fabric (E-glass), light woven aramid fabric, ½" (chopped E-glass fiber), and 1/32" (milled E-glass powder). For example, the resin matrix can include a catalyst such as, for example, methyl ethyl ketone peroxide/2% and/or butanone peroxide (32% sol)/2%. In certain embodiments, the panel comprises an oriented strand board panel.

The moisture impermeable edge reinforced wood composite structural system is suitable for use in building construction. The structural system is made by impregnating a reinforcement fiber/resin matrix material into the edges of the panel. The reinforcement fiber/resin matrix material covers the edges of the panel such that the matrix material is incorporated into the corners of the panel and into the perimeter of the panel. The reinforcement fiber/resin matrix material provides an increased moisture impermeability over an equivalent unimpregnated panel.

Also, the moisture impermeable edge reinforced wood composite structural system has enhanced strength and improved connector performance which results in greater shear wall, or diaphragm, strength and energy absorption under lateral loads due to earthquakes and major wind events.

Various objects and advantages of this invention will become apparent to those skilled in the art from the following detailed description of the preferred embodiment, when read in light of the accompanying drawings.

DETAILED DESCRIPTION OF THE INVENTION

A moisture impermeable edge reinforcement structural system provides greater strength and energy absorption than traditional wood panel products.

The moisture impermeable edge reinforcement structural system has an edge treatment that exhibits little to no edge thickness swell when applied as a surface treatment.

In certain embodiments, the moisture impermeable edge reinforcement structural system includes a reinforcement matrix material that is applied onto the edges of a wood composite panel. In certain embodiments, the composition of the reinforcement matrix material can be optimized for cost, while still achieving improved edge tear resistance and reduced nail head pull through.

Figure 3A:
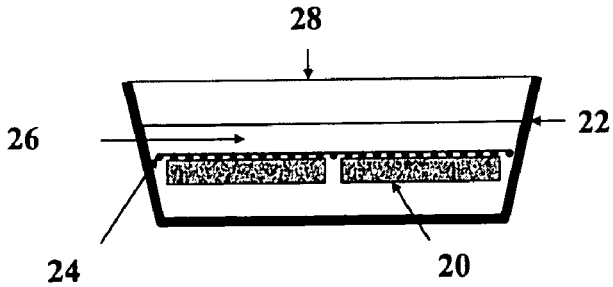
FIG. 3*a* is a schematic illustration of a submersion in water of edge-reinforced specimens (ASTM D 1037).
Figure 3B:
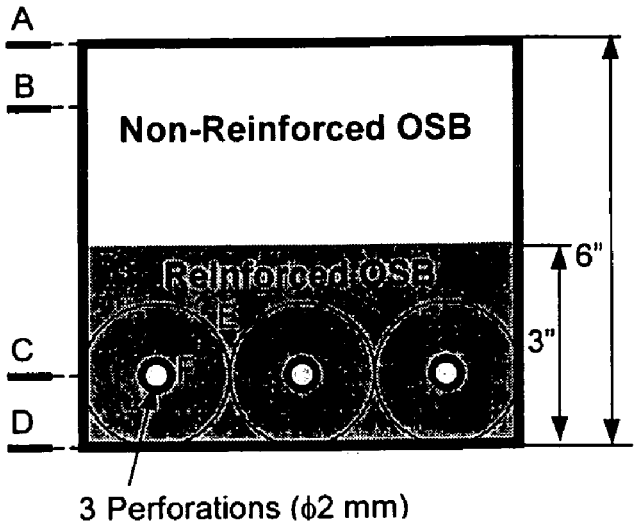
FIG. 3*b* is a schematic illustration of a specimen design (modified ASTM D 1037).
Figure 3C:
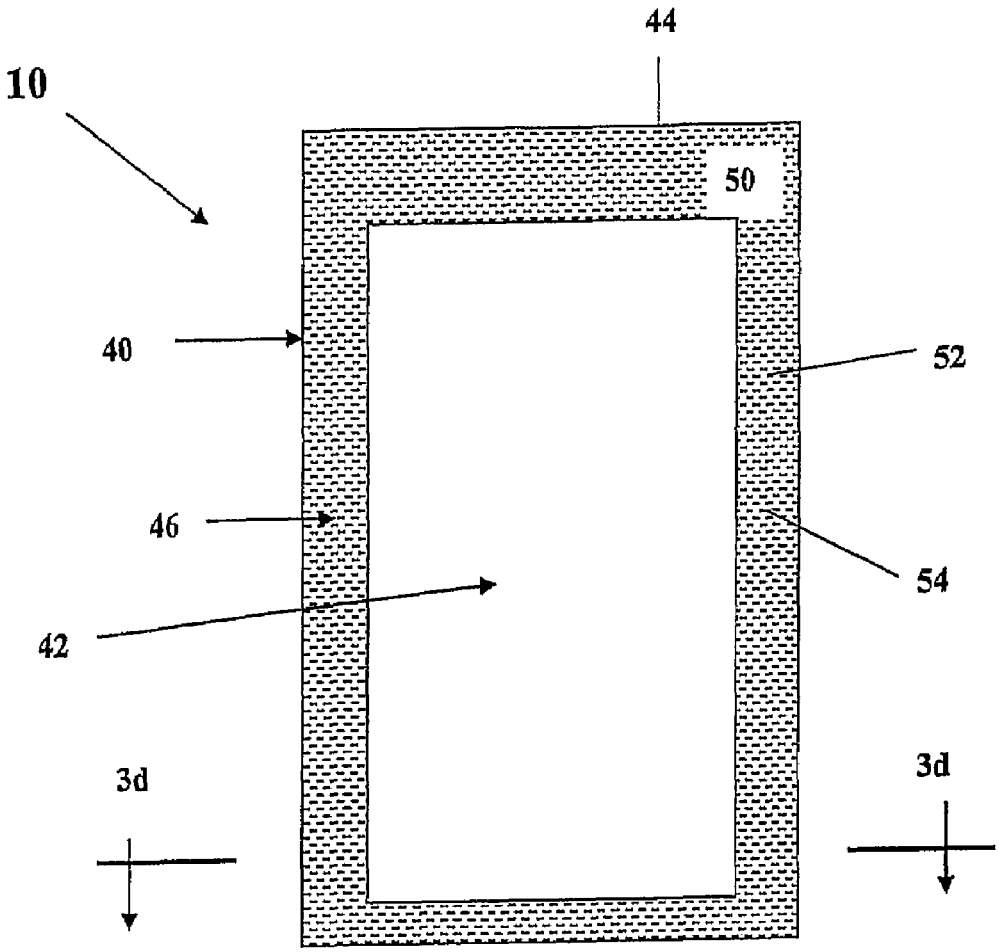
FIG. 3*c* is a schematic illustration of a moisture impermeable edge reinforced wood composite structural system comprising a wood composite panel having a perimeter zone of a reinforcement fiber/resin matrix material.
Figure 3D:
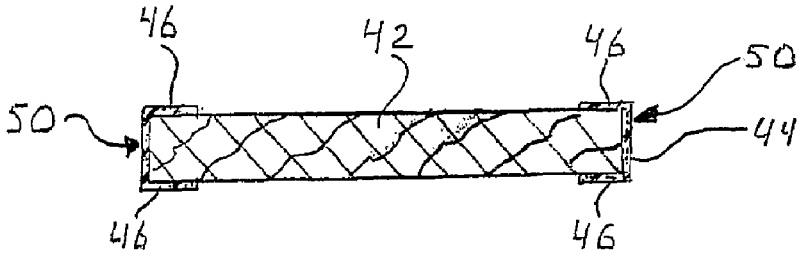
FIG. 3*d* is a view taken along the line 3*d*-3*d* in FIG. 3*c*.

Referring first to FIGS. 3*c* and 3*d*, a multi-functional reinforcement system 10 includes a wood composite panel 40 and a moisture impermeable reinforcement/resin matrix material 50. The composite panel 40 includes: at least one non-reinforced interior face, or area, 42; at least one reinforced edge 44; and, at least one reinforced perimeter zone, or area, 46.

In certain embodiments, the moisture impermeable reinforcement/resin matrix material 50 includes a reinforcement material 52 such as chopped fiberglass or glass powder and one or more resin materials 54. The moisture impermeable reinforcement/resin matrix material 50 provides the structural system 10 with improved fastener performance and reduced panel edge swell as a result of moisture exposure.

According to one embodiment, the reinforcement matrix includes glass fiber and at least one resin material which are coated onto the wood composite panel 40 using a suitable coating application technique. In certain embodiments, the reinforcement matrix material 50 is applied after the composite panel 40 has been edge trimmed and cut to a shippable size.

According to another embodiment, the reinforcement matrix includes glass fiber and at least one resin material which are impregnated into the wood composite panel 40 using a suitable impregnation technique. In certain embodiments, the reinforcement reinforcement/resin matrix material substantially covers the edges of the wood composite panel. Also, the reinforcement reinforcement/resin matrix material is substantially incorporated into corners of the wood composite panel and into a perimeter of the wood composite panel so that the reinforcement/resin matrix material provides an increased moisture impermeability over an equivalent unimpregnated wood composite panel.

In certain embodiments, the resins useful in the moisture impermeable edge reinforcement matrix comprise at least one of polyester (PE) and vinyl ester (VE). The wood composites comprised oriented strandboard (OSB) panels coated with PE and VE resins perform well when exposed to liquid water. In certain embodiments, E-glass reinforcement in the form of woven fabric is also useful in the edge reinforcement matrix material because of its excellent mechanical properties, compatibility with conventional wood resins, low cost and wide availability.

In certain other embodiments, the edge reinforcement matrix materials include chopped glass strands or glass powder mixed with the PE or VE resins. The fiber and powder reinforced matrix system significantly improves material handling and facilitates reinforcement application on the OSB support.

Also, in certain embodiments, the moisture impermeable edge reinforcement matrix covers a surface area that is within the range of from about 3% to about 15%, of the surface area of the panel. For example, in certain embodiments of structural systems, the surface area coverage is about: ½" wide strip on surface is about 3%; a 1" wide strip is about 6%; and, a 2" wide strip on the surface is about 12%.

It is to be understood, that it is within the contemplated scope of the present invention that the moisture impermeable edge reinforcement matrix can be applied with appropriate equipment within or adjacent to a wood composite plant.

Also in certain embodiments, the moisture impermeable reinforcement matrix material can include a catalyst such as, for example, methyl ethyl ketone peroxide/2% and/or butanone peroxide (32% sol)/2%.

EXAMPLES

Materials tested were polyester (PE), vinyl ester (VE), polyurethane (PU), melamine (ME), oil-based coating (tung oil), water-based coating (waterseal), and hydroxymethylated resorcinol (HMR). After the initial screening tests, the following materials were selected for edge coating: PE, VE, PU, ME and tung oil. The PE, VE and ME were mixed with catalyst as prescribed by the supplier, as shown in Table 1, and applied to OSB in a single layer by brushing.

TABLE 1

| Wood composites and synthetic materials used in the project | |
|---|---|
| Wood-based Composite: Regular OSB panels | |
| Resin | Catalyst/Percent used |
| Polyester (PE) | Methyl Ethyl Ketone Peroxide/2% |
| Vinyl Ester (VE) | Butanone Peroxide (32% sol)/2% |
| Polyurethane (PU) | Ready-to-Use |
| Melamine (ME) | Aluminum Chloride (28% sol)/3% |
| Tung Oil | Ready-to-Use |
| Reinforcements (used with PE/VE resins) | |
| Light Woven Glass Fabric (E-Glass) | |
| Light Woven Aramid Fabric | |
| ½" (Chopped E-Glass Fiber) | |
| 1/32" (Milled E-Glass Powder) | |

Tung oil was applied to the OSB edge by 15 mm immersion followed by 45 mm drying, operation repeated three times. As many as four coats of PU were sprayed on OSB as recommended by the supplier for exterior usage. All samples were conditioned in an environmental chamber at 25° C. and 65% RH prior to coating and 48 hours after coating.

Light types of woven fiberglass fabric (E-glass of 207 g/m$^2$) and woven aramid fabric (165 g/m$^2$) were selected for the first generation of reinforcement materials, and used along with the thermosetting resins PE and VE. The reinforcement materials (1) provide good moisture resistance, and (2) act as a matrix for the reinforcement system. The third, and comparative, type of reinforcement material considered was light chopped strand mat (E-glass of 225 g/m$^2$) but after coating, the moisture exposure tests were discontinued, because of problems with the application of the mat on the edge of the board. It was impossible to mold the chopped strand mat (CSM) intimately on the edge and keep it in place until the resin cured. After curing, large air bubbles were apparent at the edge of the reinforced samples.

All samples were kept in a controlled environmental chamber prior to coating, after coating and during testing, to avoid exposure to large fluctuations of temperature and relative humidity.

For a second generation of reinforcement materials, chopped E-glass fibers or milled E-glass powder mixed with resin was used. This manner of application has the advantage of better material handling, and is a more economical option for large scale applications. One-half inch chopped E-glass fibers and 1/32" milled E-glass powder were used in combination with PE or VE resin. In one embodiment, the optimum fiberglass-to-resin weight mixture ratio was about 15:85. In another embodiment, the optimum powder-to-resin weight mixture ratio was about 30:70. Untreated fumed silica dioxide was added into the mixture as a thixotrope (flow control) agent to inhibit resin dripping off vertical surfaces.

Evaluation of Edge Coating Under Accelerated Conditions

Figure 1:
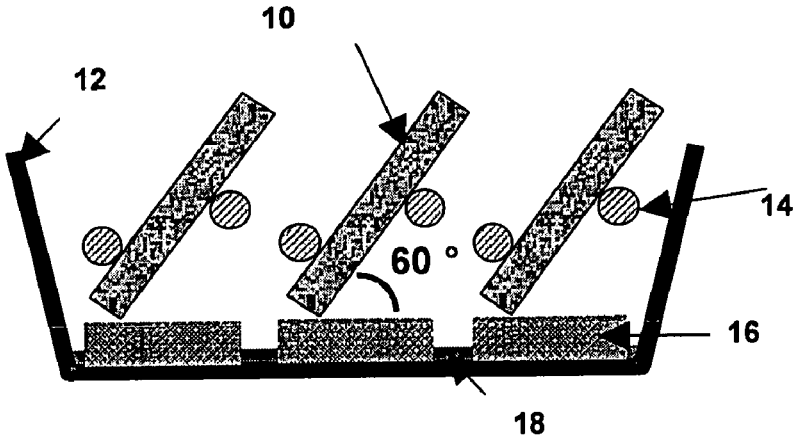
FIG. 1 is a schematic illustration of an evaluation of edge performance under accelerated conditions (ASTM D 2065).
Figure 2:
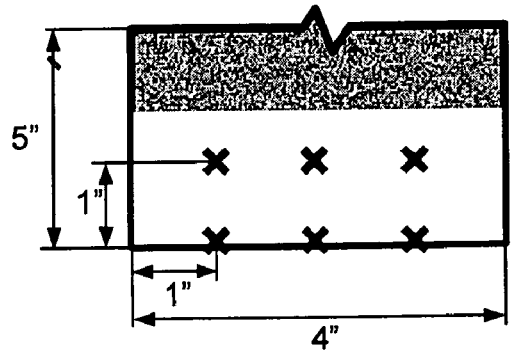
FIG. 2 is a schematic illustration of a specimen detail (ASTM D 2065).

The test procedure ASTM D 2065 was performed for evaluation of edge coating under accelerated conditions, using a water-surfactant solution containing 1% Merpol SI-I Surfactant, a non-reactive solution for the coatings selected, as shown in FIG. 1. One edge of a 4"×5" sample 10 was positioned a tray 12 and held with a holding device 14. The sample 10 was exposed to a moist environment consisting of sponges 16 wetted with distilled water and surfactant (1%) solution 18 for 48 hours, then oven-dried at 104° C. for 24 hours, and finally, conditioned again in the environmental chamber to equilibrium moisture content. Weight and thickness measurements were performed at ambient conditions after a 2-hour exposure, 48-hour exposure, oven-drying and after attaining equilibrium. The thickness of the panels was measured at three locations, both at the edge and at 1 inch from the edge, as shown in FIG. 2.

Effect of Edge Reinforcement on Panel Dimensional Stability

The effect of edge reinforcement on panel dimensional stability was further investigated by submersion in water of edge-reinforced specimens, according to ASTM D 1037, as shown in FIG. 3*a*. Six by six inch un-reinforced regular OSB samples 20 were placed in a tray 22, and held under a steel rack 24 in water 26. The tray 22 was covered with a plastic foil 28. The samples were half reinforced with woven fiberglass fabric (E-glass of 207 g/m$^2$) using either polyester (PE) or vinyl ester (VE) matrix systems, as shown in FIG. 3*b*.

The other half of the sample was not reinforced, and used as a control. Moreover, three small perforations (Φ2 mm), like those resulting from nail holes, were created at 1 inch from the edge to allow water penetration into the system. All samples were submerged horizontally under 1 inch of distilled water kept at a constant temperature of 20±1° C. The trays were covered with plastic foil to reduce water evaporation.

Connector Performance

Standard tests for nail withdrawal and nail-head pull-through (ASTM D1037) were performed to evaluate the fastener performance of the new reinforced materials. The nail withdrawal test determines the load required pulling a standard size nail from the panel specimen, and nail-head pull-through test investigates the force required to pull the nail head through the specimen. The tests were performed on 3 inch by 6 inch specimens. Two groups of specimens were tested: (1) coated with different types of resins, (2) reinforced with woven fiberglass fabric, woven aramid fabric or chopped strand mat (CSM). The resin application rate was 0.05 g/cm$^2$ for fiberglass or aramid, and 0.10 g/cm$^2$ for CSM.

The samples were pre-conditioned and tested at about 25° C. and 65% relative humidity (RH). Specimen thickness was measured with an accuracy of ±0.3%. Two types of common wire nails were used: sixpenny and eight-penny nails. For the nail withdrawal tests, nails were hand-driven immediately before testing such that the exposed length of the nail was equal on both sides of the specimen, and for the nail-head pull-through tests, nails were hand-driven completely through the panel. Loading was applied at a constant rate of 0.06 inch/mm (1.5 mm/mm). The test results were compared to the performance of reference uncoated and unreinforced OSB panels.

Lateral Resistance of the Fasteners

Determination of the lateral fastener resistance of the edge-reinforced OSB panels was estimated in accordance with ASTM D 1761. Eight-penny nails or screws, nominally 0.131 inch in diameter and 2½ inch in length were power driven at the minimum recommended edge distance of ⅜ inch. Lateral fastener resistance of fiber, powder or fabric edge-reinforced panels was compared to the performance of un-reinforced regular OSB, premium OSB (Advantec® OSB) and plywood. Half of the samples were soaked in water for 24 hours prior to testing, and the other half of the samples were pre-conditioned and tested at constant temperature (25° C.) and RH (65%). This allowed for a comparison between the performance of different reinforcements while in the dry and wet state.

Environmental Performance of the Reinforced Specimens

Environmental performance of reinforced OSB was determined using a QUV Tester that reproduces the damage caused by sunlight, rain and dew. The edge-reinforced specimens were exposed to alternating cycles of light and moisture at controlled elevated temperatures. Total QUV exposure time was 588 hours, consisting of 2-hour alternating cycles of 85% UV and 15% water spray. After the QUV exposure, the samples were oven dried at 104° C., and placed in a controlled environmental chamber for at least 48 hours prior to testing. Then, two tests specified in ASTM D1037 were performed on reinforced OSB specimens, nail withdrawal and nail-head pull-through, to evaluate the fastener performance of the QUV-exposed reinforced OSB. The samples were tested at about 25° C. and 65% RH. The test results were compared to the performance of non-exposed reinforced OSB.

Shear Wall Tests

The static shear wall tests were performed in accordance with ASTM E 564, with the exception that higher test loads were used. The higher loads are necessary to exceed the allowable design load of the wall before the third half cycle. Normal construction practices were followed for wall framing construction. The un-reinforced sheathing was attached to the frame with power driven 8 d smooth nails (Φ0.12×2.5) with 6 inch perimeter nail spacing. The wall was bolted to the base beam with ¾" diameter bolts in four locations. The bolts were tight fit in the holes to prevent slippage of the base. Overturning restraints (i.e., "tension tie downs") were also installed at both bottom corners of the wall. Once the wall was completely tightened along the bottom, it was then attached to the load distribution beam with ¾" diameter bolts. The beam rests on four steel tubes that sit on top of the wall.

Figure 4:
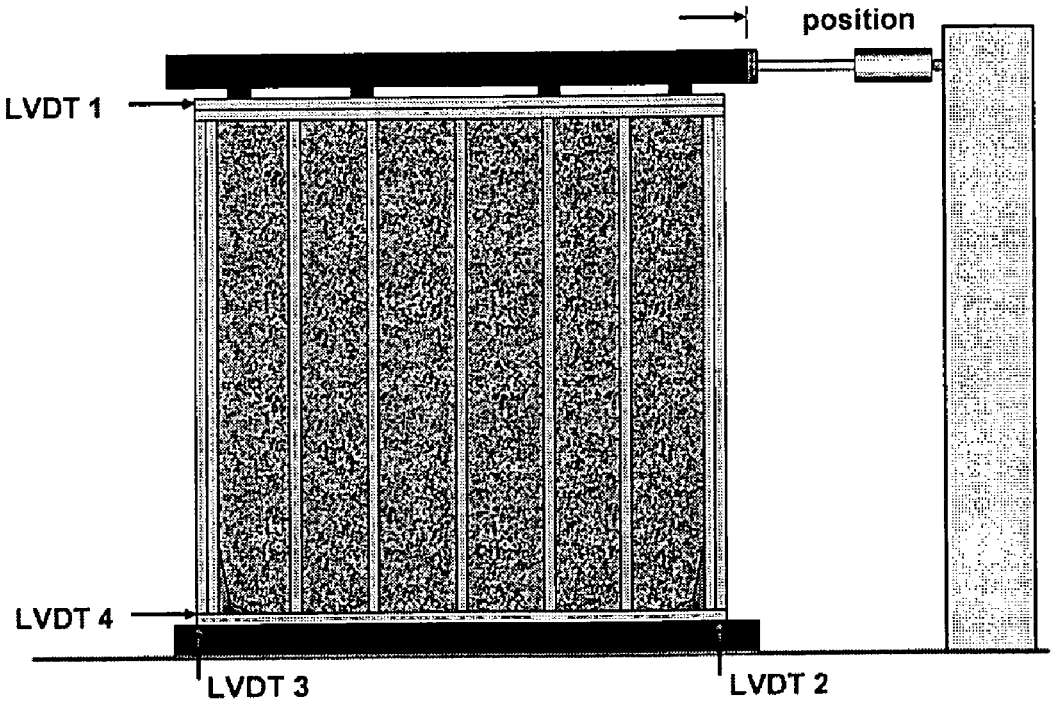
FIG. 4 is a schematic illustration of a test set-up for shear walls loaded statically or cyclically.

All displacements were measured with DCDTs or string potentiometers in the locations labeled LVDT 1 through 4 in FIG. 4, to measure slip at base, uplift at the bottom of the loaded end, top plate horizontal displacement and vertical displacement at the top of the wall. The loading consisted of three half cycles. The static loading protocol was developed based on the results obtained for the lateral nail tests. In the first half cycle the specimen was loaded at a rate of 20 lb/s to a peak load of 2500 lb, and then unloaded to zero load at the same rate. The second half cycle consisted of loading the specimen to approximately 5000 lb. and then unloading to zero again. Following the second unloading, the wall was loaded to failure.

The static loading history used for shear walls is shown in Table 2. Three replications were tested statistically.

TABLE 2

Static loading protocol for shear walls

| $1^{st}$ Cycle Peak Load (lb) | $2^{nd}$ Cycle Peak Load (lb) | $3^{rd}$ Cycle Peak Load (lb) |
|---|---|---|
| 2500 | 5000 | Load to failure |

The quasi-static cyclic load testing of shear walls was performed in compliance with the "Basic Loading History" developed by CUREE (Krawinkler et al., 2000). This protocol was developed using actual ground motions recorded in California.

Figure 5:
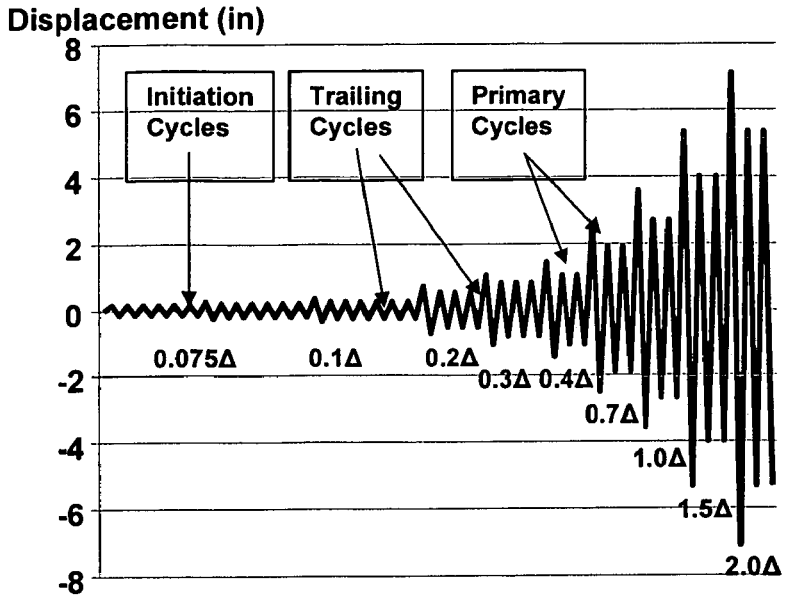
FIG. 5 is a graph showing loading history for the CUREE protocol.

The loading history was developed from the results of the static wall tests, and is composed of 43 total cycles of varying amplitude, as shown in FIG. 5. The sequence of cycles consists of: (1) initiation cycles, which are meant to check the equipment; (2) primary cycles, that are larger than all the preceding cycles; and (3) trailing cycles, which have amplitudes of 75% of the amplitude of the preceding primary cycle. All cycles are symmetric in the positive and negative directions. Normal construction practices were followed for wall framing construction. Two types of fasteners were used to attach the sheathing to the frame, 3 d smooth nails (Φ0.12×2.5) or 8 d exterior screws (Φ0.12×2.5) using a 6 inch perimeter nail spacing. The cyclic wall test matrix is shown in Table 3.

TABLE 3

Cyclic wall test matrix for shear walls with nails

| Reinforcement | Polyester (PE) | Vinyl Ester (VE) |
|---|---|---|
| Woven Glass Fabric | 3 | 3 |
| Chopped Glass Fibers | 3 | 3 |
| Milled Glass Powder | 3 | 3 |
| Regular OSB (Control) | 3 | |

Edge Coating Performance

No significant effect of sampling from a particular panel or a particular position within one panel was found. After 48 hours of testing, HMR and waterseal showed an insignificant difference in moisture uptake as compared with the controls, proving them unsuitable for edge coating. The high amount of moisture gained by the waterseal edge-coated samples could be explained by the extreme conditions created by the OSB surface and surfactant. The PE coating showed excellent swelling reduction, with no thickness swelling even after a long exposure time (21 days).

Figure 6:
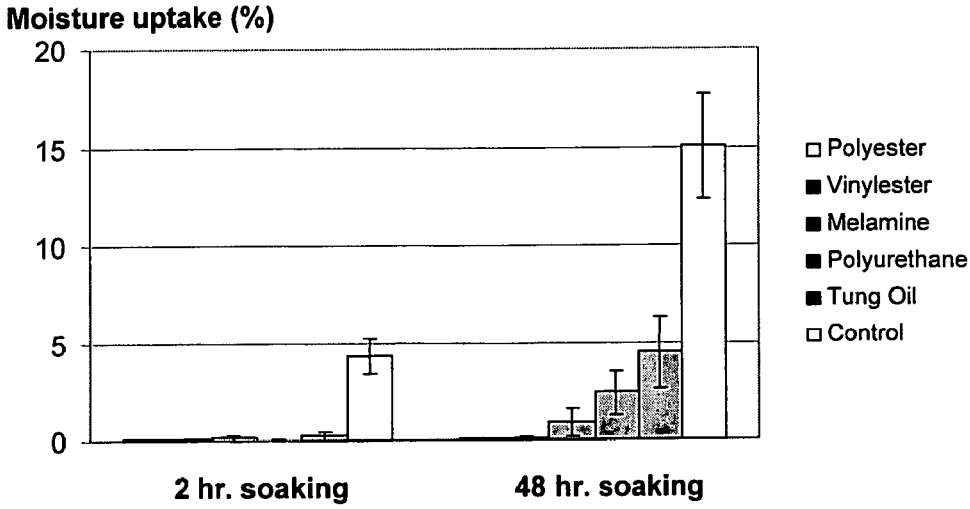
FIG. 6 is a graph showing moisture uptake for edge-coated OSB (ASTM D 2065) impregnated with, from left-to-right: polyester (PE), vinyl ester (VE), melamine, polyurethane, tung oil, and control.

FIG. 6 is a graph which shows moisture uptake for edge-coated OSB. Less than 1% water uptake was observed after the first 2-hour exposure and less than 5% water uptake after the 48-hour exposure. The corresponding values for the control were 4.3% and 15% respectively.

Figure 7:
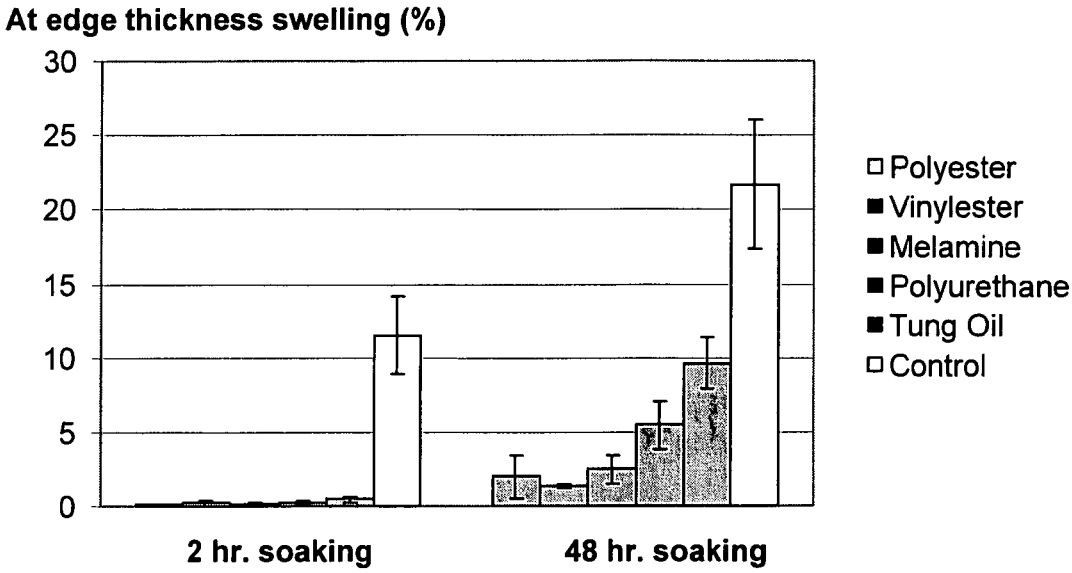
FIG. 7 is a graph showing thickness swelling at the edge for edge-coated OSB (ASTM D 2065) impregnated with, from left-to-right: polyester (PE), vinyl ester (VE), melamine, polyurethane, tung oil, and control.
Figure 8:
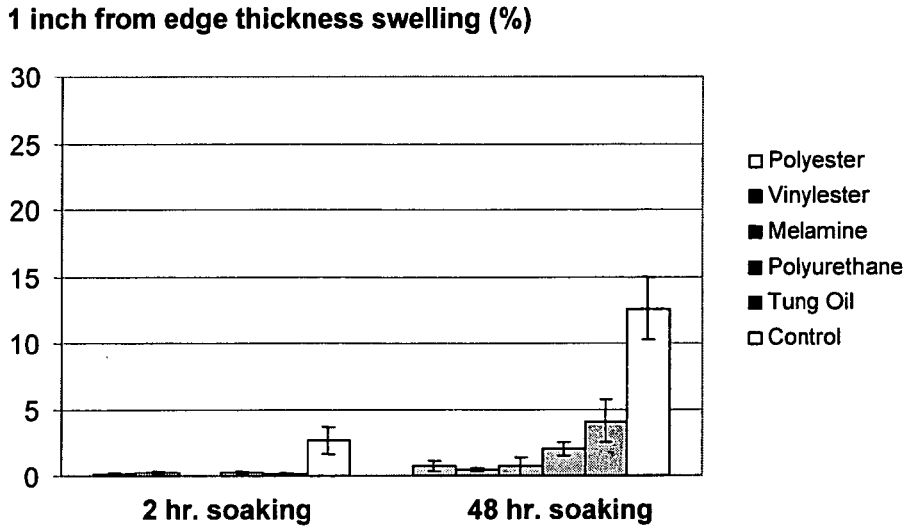
FIG. 8 is a graph showing thickness swelling at 1 inch from the edge for edge-coated OSB (ASTM D 2065) impregnated with, from left-to-right: polyester (PE), vinyl ester (VE), melamine, polyurethane, tung oil, and control.

Thickness swelling measured at the edge is shown in FIG. 7 and thickness swelling at 1" from the edge in FIG. 8. Thickness swelling measured at the edge was less than 1%, and at 1 inch from the edge was less than 0.3% after the 2-hour exposure as compared with 11.5% and 2.7% for the uncoated control. After the 48-hour exposure, samples coated with tung oil swelled 9.6%, PU 3.5%, and PE, VE and ME about 2% at the edge. All reinforced samples swelled less than 4% at 1 inch from the edge after 48-hours. The corresponding values for the uncoated control were 21.7% and 12.5%, respectively. Although the melamine resin produced a clear coating on the OSB, during exposure it presumably reacted with the water-surfactant solution, partially damaging the coating. PE and VE were selected for further investigation as matrix systems for edge reinforcement for their proven excellent swelling reduction, and also for their suitability as matrix fillers for the existing commercial reinforcements systems.

Dimensional Stability of Edge Reinforced Panels (1) Edge Exposure Test (ASTMD 2065)

Figure 9:
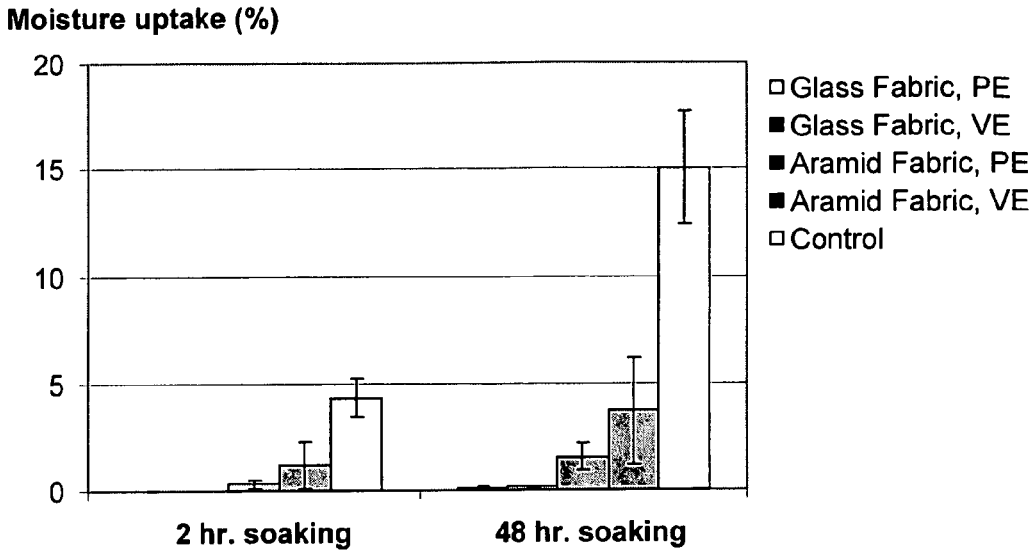
FIG. 9 is a graph showing moisture uptake for edge-reinforced OSB (ASTM D 2065), from left-to-right, having edges with: glass fabric and PE, glass fabric and V E, aramid fabric and PE; aramid fabric and VE, and a control.

Moisture uptake for edge reinforced OSB is shown in FIG. 9. Generally, lower moisture uptake and thickness swelling were observed for the glass systems than for the aramid systems. Only negligible water uptake was observed for the glass/PE and glass/VE systems, 0% after the 2-hour exposure and 0.1% after the 48-hour exposure (compared with 4.3% and 15% for the uncoated control). Water absorption after the 48-hour exposure was 1.5% when using aramid fabric in combination with PE, and 3.7% when used with VE.

Figure 10:
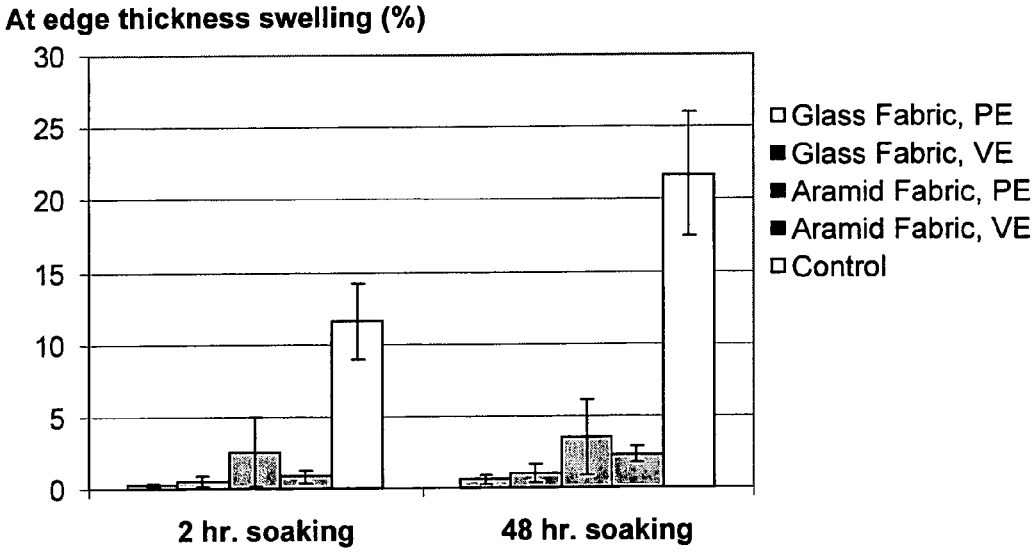
FIG. 10 is a graph showing thickness swelling at the edge for edge-reinforced OSB (ASTM D 2065), from left-to-right, having edges with: glass fabric and PE, glass fabric and V E, aramid fabric and PE; aramid fabric and VE, and a control.
Figure 11:
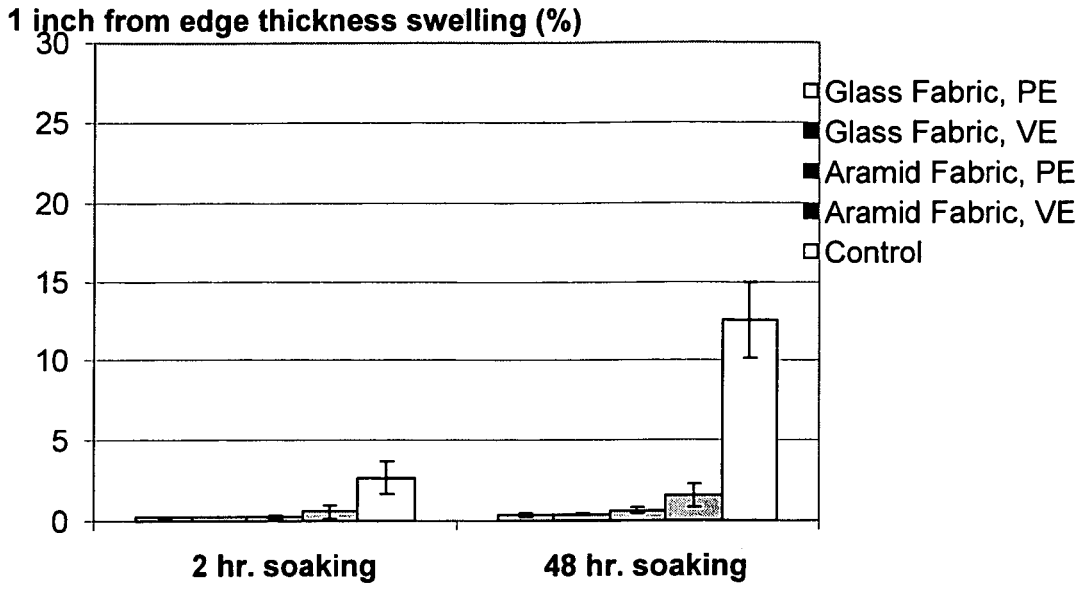
FIG. 11 is a graph showing thickness swelling at 1 inch from the edge for edge-reinforced OSB (ASTM D 2065), from left-to-right, having edges with: glass fabric and PE, glass fabric and V E, aramid fabric and PE; aramid fabric and VE, and a control.

FIG. 10 is a graph which shows the thickness swelling at the edge and FIG. 11 is a graph which shows the thickness swelling at 1" from the edge for edge-reinforced OSB. After the 2-hour exposure, samples swelled less than 2.5% at the edge (11.5% for controls), and 0.6% at 1 inch from the edge (2.7% for controls). After 48 hours exposure, thickness swelling for all reinforced samples was less than 3.5% at the edge, and less than 1.5% at 1 inch from the edge, as compared with 22% and 12.5% for the control. The amount on non-recoverable thickness swelling was lower for reinforced panels as compared with coated panels.

(2) Immersion Test (ASTMD 1037)

Figure 12A:
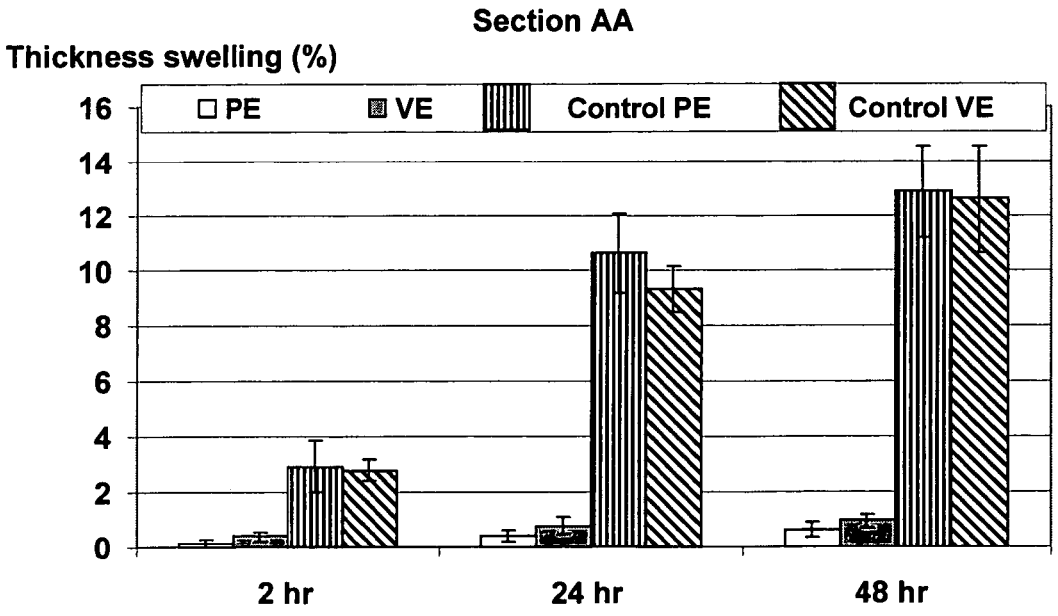
FIG. 12*a* is a graph showing thickness swelling at the edge for edge-reinforced OSB (ASTM D 1037).
Figure 12B:
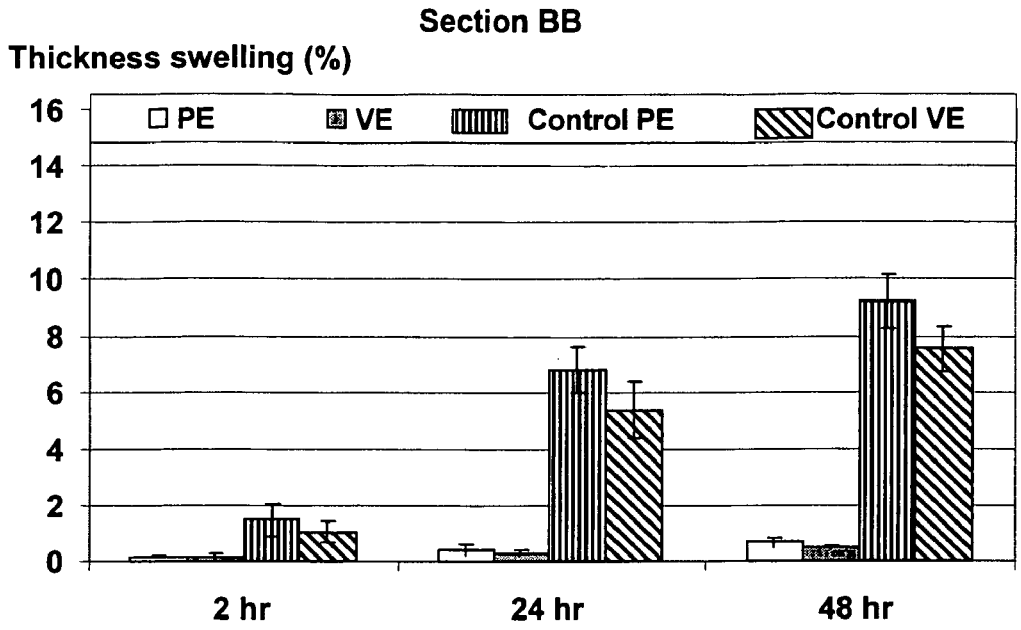
FIG. 12*b* is a graph showing thickness swelling at 1 inch from the edge for edge-reinforced OSB (ASTM D 1037).
Figure 13A:
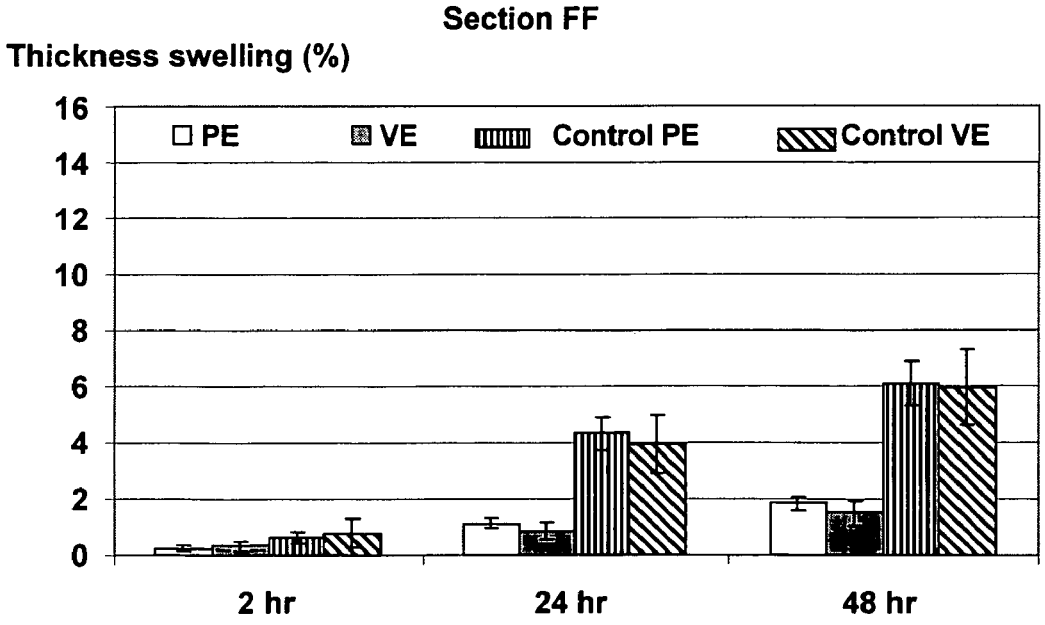
FIG. 13*a* is a graph showing thickness swelling near perforation for edge-reinforced OSB (ASTM D 1037).
Figure 13B:
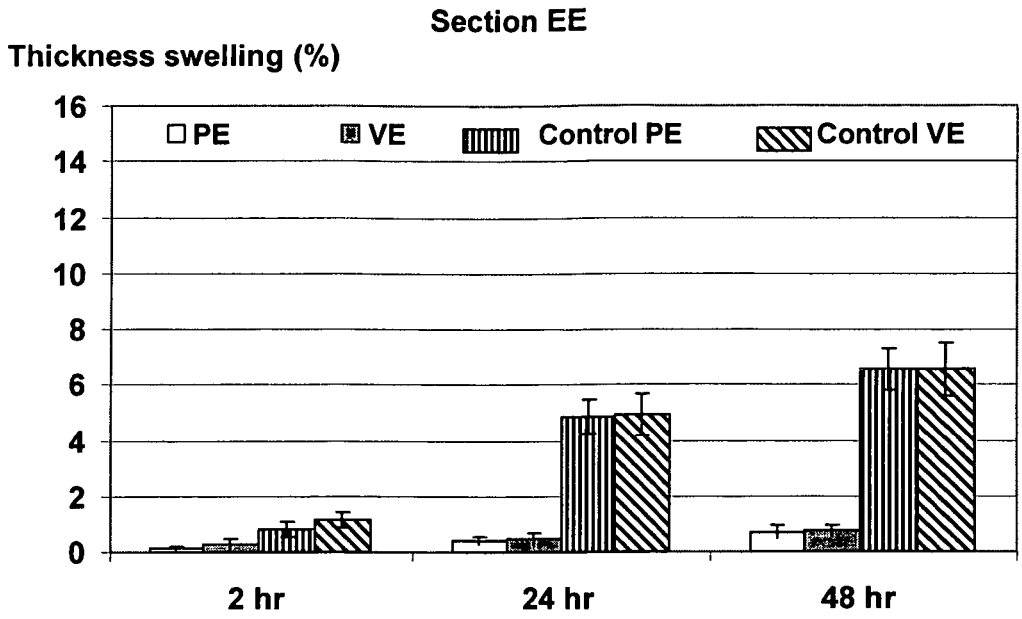
FIG. 13*b* is a graph showing thickness swelling at 1 inch radius from perforations for edge-reinforced OSB (ASTM D 1037).

Thickness measurements were performed on the edge (e.g., see in FIG. 3*b*-A, D), at 1 inch from the edge (e.g., see in FIG. 3*b*-B, C), near the perforations (e.g., see in FIG. 3*b*-F) and at 1 inch from the perforations (e.g., see in FIG. 3*b*-E), after a 2-hour exposure, 24-hour and 48-hour exposures. Results related to the submersion in water test are shown in FIG. 12 and FIG. 13.

Only negligible thickness swelling was observed at the edge for the reinforced systems, 0.3% after a 2-hour exposure, 0.6% after a 24-hour exposure and 0.8% after a 48-hour exposure (compared with 2.9%, 10.0% and 12.7% for the un-reinforced control). Thickness swelling at 1 inch from the edge was reduced to a greater extent: 0.1% after a 2-hour exposure, 0.3% after a 24-hour exposure and 0.6% after a 48-hour exposure (compared with 2.5%, 6.1% and 8.4% for the uncoated control).

Similar paths were observed for the un-reinforced OSB near the perforation and at 1 inch from the perforation. Reinforced OSB swelled about two times more near the perforation than at 1 inch from the perforation.

Connector Performance of Edge Reinforced Panels (1) Nail Withdrawal and Head Pull-Through Performance (ASTM D 1037)

Figure 14:
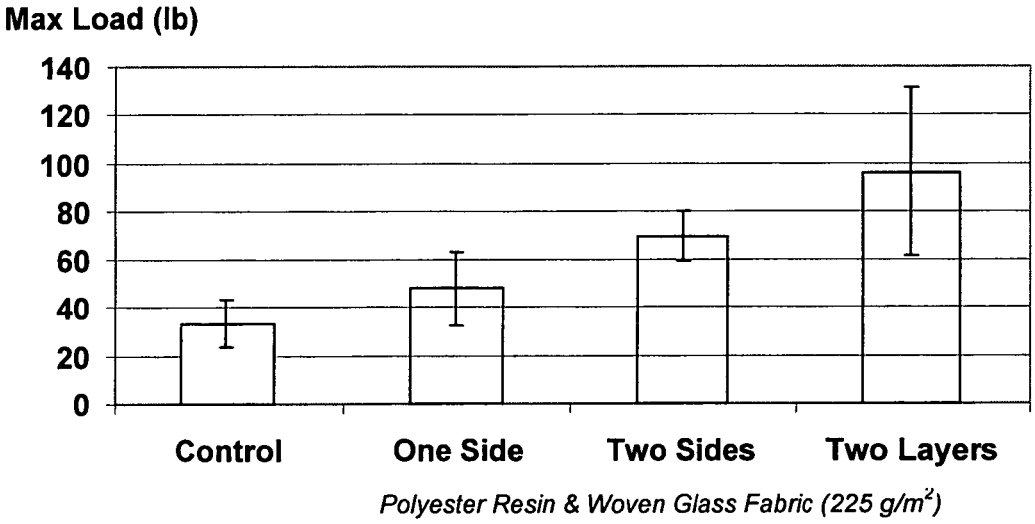
FIG. 14 is a graph showing sixpenny nail withdrawal test—Influence of resin layers (ASTM D 1037).

Nail withdrawal capacity increases with the number of resin/fabric layers added to the wood-based support, as shown in FIG. 14. This observation is also valid for the nail-head pull-through tests.

Figure 15:
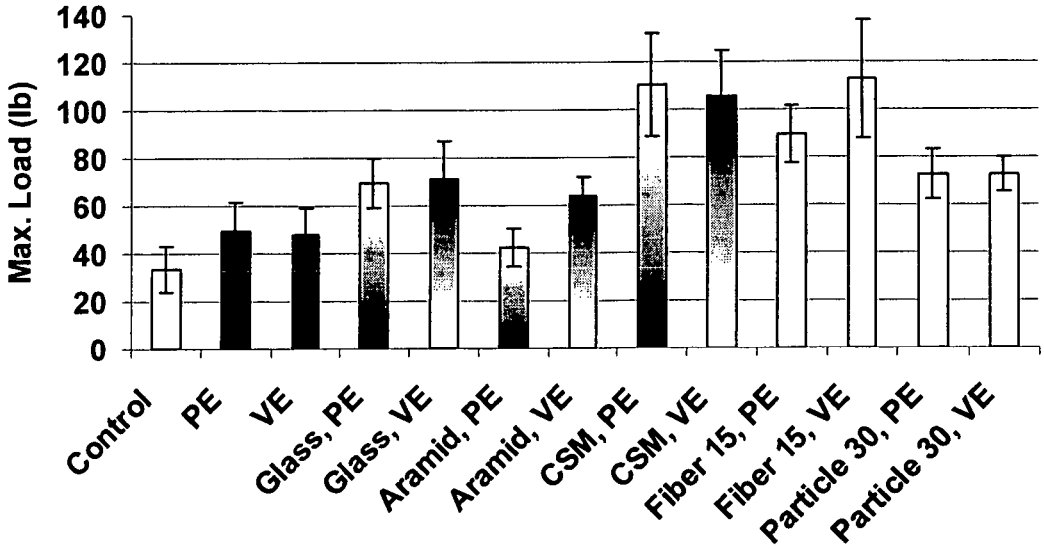
FIG. 15 is a graph showing sixpenny nail withdrawal test—Fabric and resin comparison (ASTM D 1037).

FIG. 15 shows the comparison of different coating and reinforcement systems for the sixpenny nail withdrawal test. An average withdrawal capacity of 62 lb was obtained for glass reinforced OSB; 53 lb for aramid; and, 107 lb for CSM reinforced panels, as compared with 33 lb for controls. It should be pointed out that resin application rate on CSM fabric was double the rate applied to the other two fabrics, glass and aramid.

Figure 16:
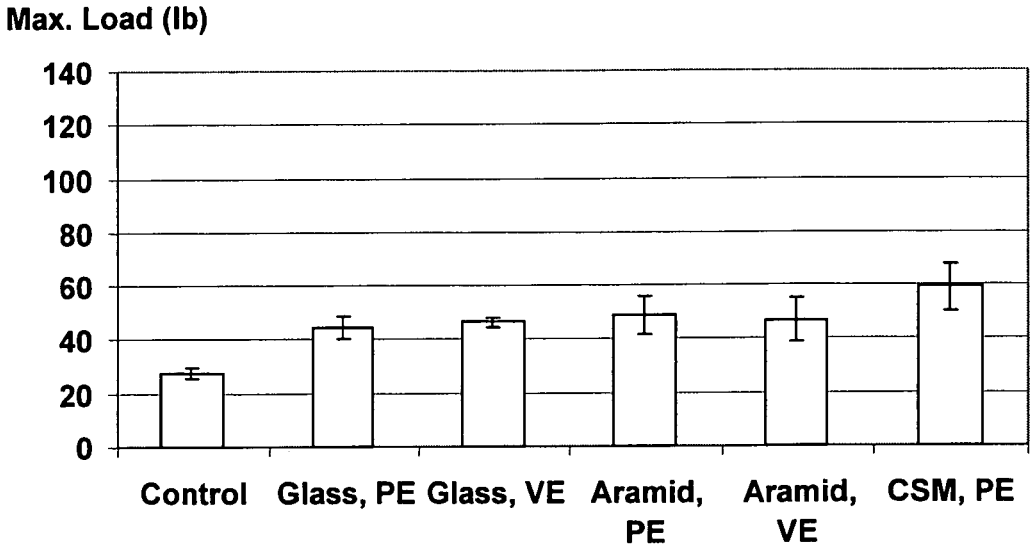
FIG. 16 is a graph showing eight penny nail withdrawal test—Fabric and resin comparison (ASTM D 1037).

Results obtained for eight-penny nails were slightly lower that those obtained for sixpenny nails, as shown in FIG. 16.

Figure 17:
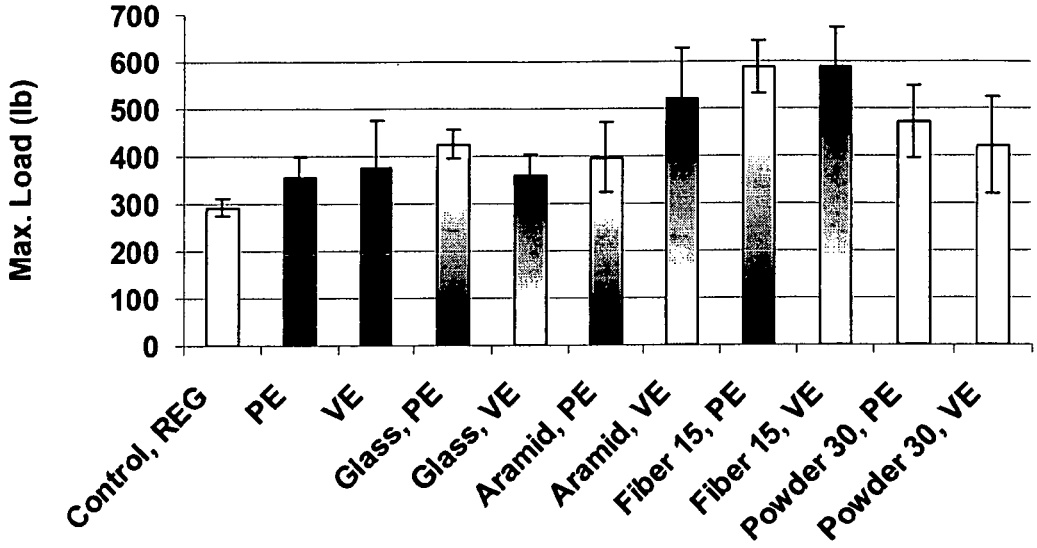
FIG. 17 is a graph showing sixpenny nail-head pull-through test—Fabric and resin comparison (ASTM D 1037).

Results related to sixpenny nail-head pull-through test are shown in FIG. 17. On average, nail-head pull-through capacity was about 350 lb for the resin-coated OSB and above 400 lb for the fabric-reinforced OSB, as compared with 300 lb for controls. Among the reinforcement materials, CSM and aramid systems performed slightly better than the glass fabric, for both sixpenny and eight-penny nails.

Figure 18:
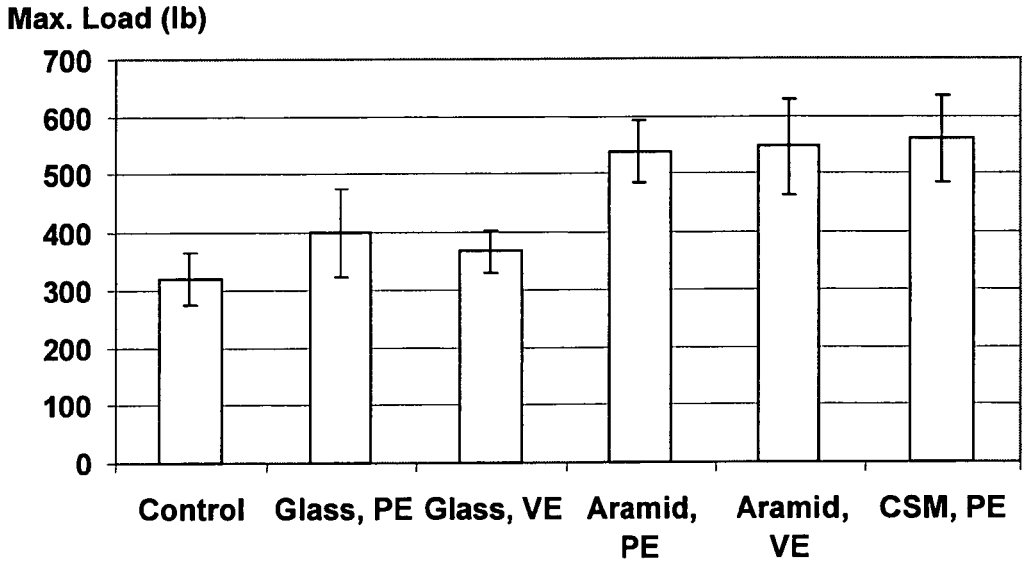
FIG. 18 is a graph showing eight penny nail-head pull-through test—Fabric and resin comparison (ASTM D 1037).

Results for the eight-penny nail pull-through test are shown in FIG. 18. The fabric reinforced OSB composites tended to fail locally, around the nail head and on the entire thickness of the panel. Generally, the systems using PE resin seemed to perform slightly better than those using VE resin, except for the aramid and PE systems. A student t-test for glass-PE and glass-VE systems showed, however, that there was not a statistically significant difference between the two systems.

Figure 19:
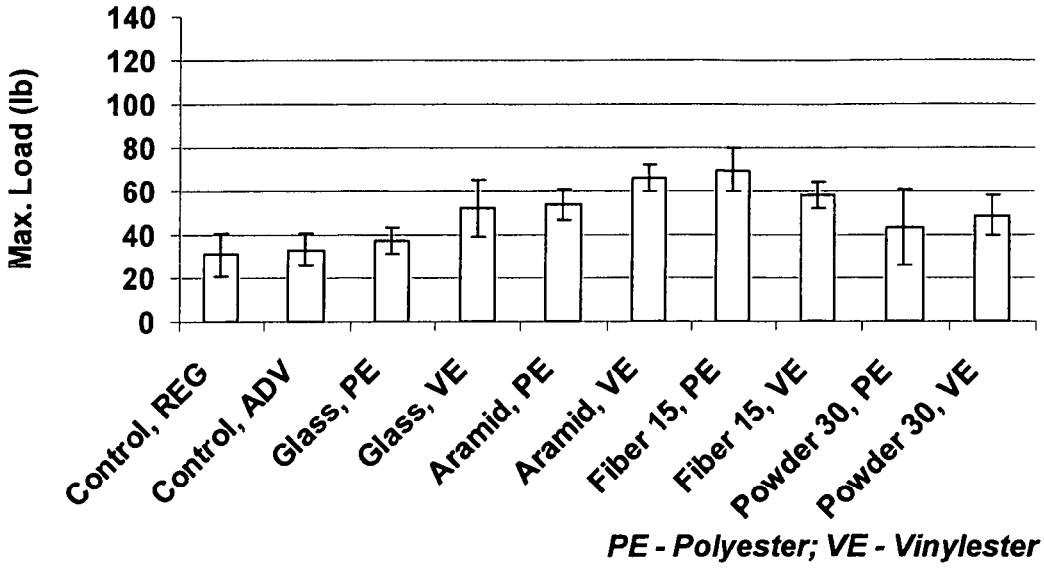
FIG. 19 is a graph showing nail withdrawal results for QUV exposed systems (ASTM D 1037).

The results related to nail withdrawal and nail-head pull-through tests using QUV-exposed specimens are shown in FIG. 19. In general, lower withdrawal capacities were obtained for the QUV-exposed reinforced OSB systems as compared to the non-exposed OSB systems. However, results obtained for the reinforced OSB were higher than those obtained for regular OSB and premium OSB (Advantec® OSB).

Figure 20:
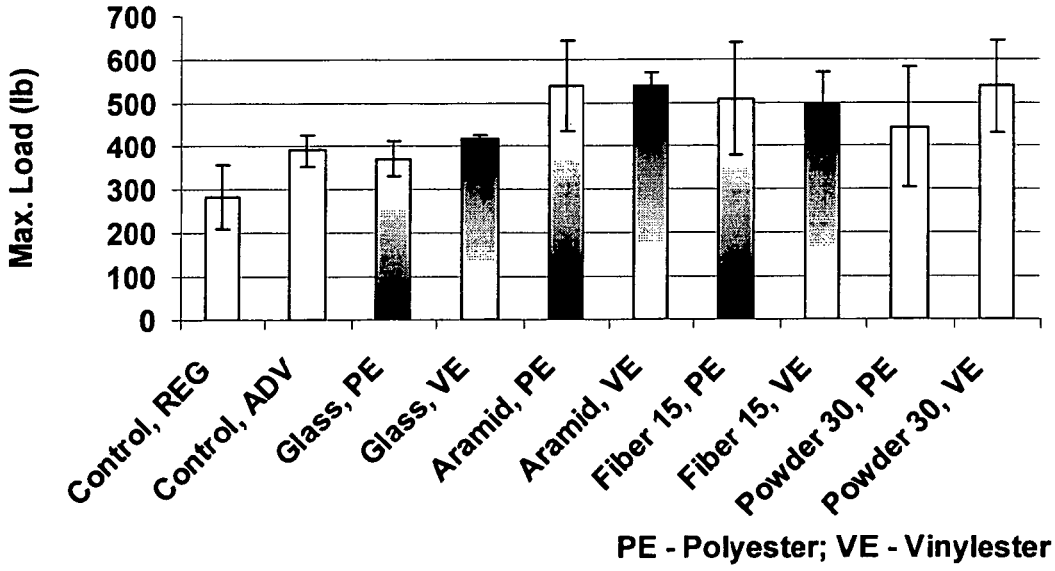
FIG. 20 is a graph showing nail-head pull-through results for QUV exposed systems (ASTM D 1037).

On the other hand, the nail-head pull-through capacities for QUV exposed systems were comparable to those of non-exposed systems, as shown in FIG. 20. Results for both QUV-exposed and non-exposed systems were in the 500 lb. range, as compared to 400 lb. obtained for premium OSB (Advantec® OSB), and 300 lb. for regular non-reinforced OSB.

Nail withdrawal and nail-head pull-through capacities of the fiber and powder edge-reinforced OSB were compared for different resin-fiberglass proportions. Nail withdrawal and pull-through capacities were equal or higher when compared with the results obtained for the CSM. Both reinforcement mixtures were spread on the composite edge with a putty knife, making these systems easier-to-apply and therefore preferred from a technological point of view.

Lateral Nail/Screw Performance (ASTM D 1761)

Figure 21:
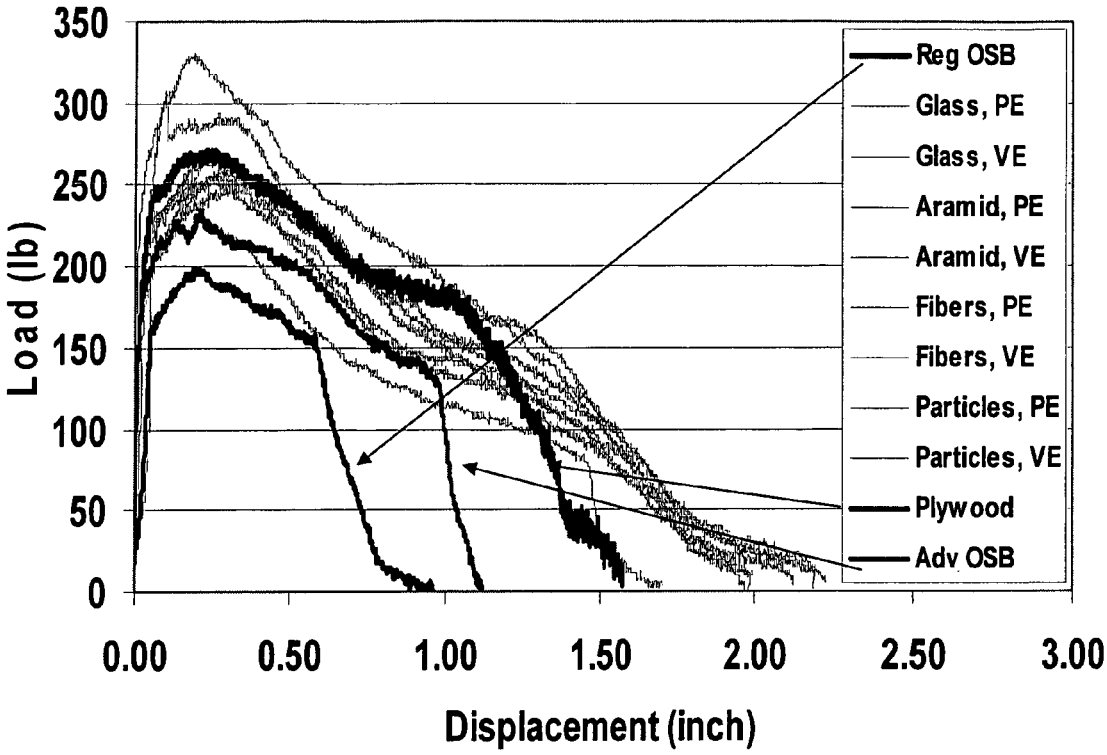
FIG. 21 is a graph showing lateral nail resistance results for dry samples (ASTM D 1761).

The major results relevant to lateral nail resistance behavior are shown in FIG. 21. A lateral nail resistance of about 200 lb. was obtained for un-reinforced regular OSB, 220 lb. for premium OSB (Advantec® OSB), and 250 lb. for plywood. The range for edge-reinforced systems was between 250 lb. and 320 lb.

Figure 22:
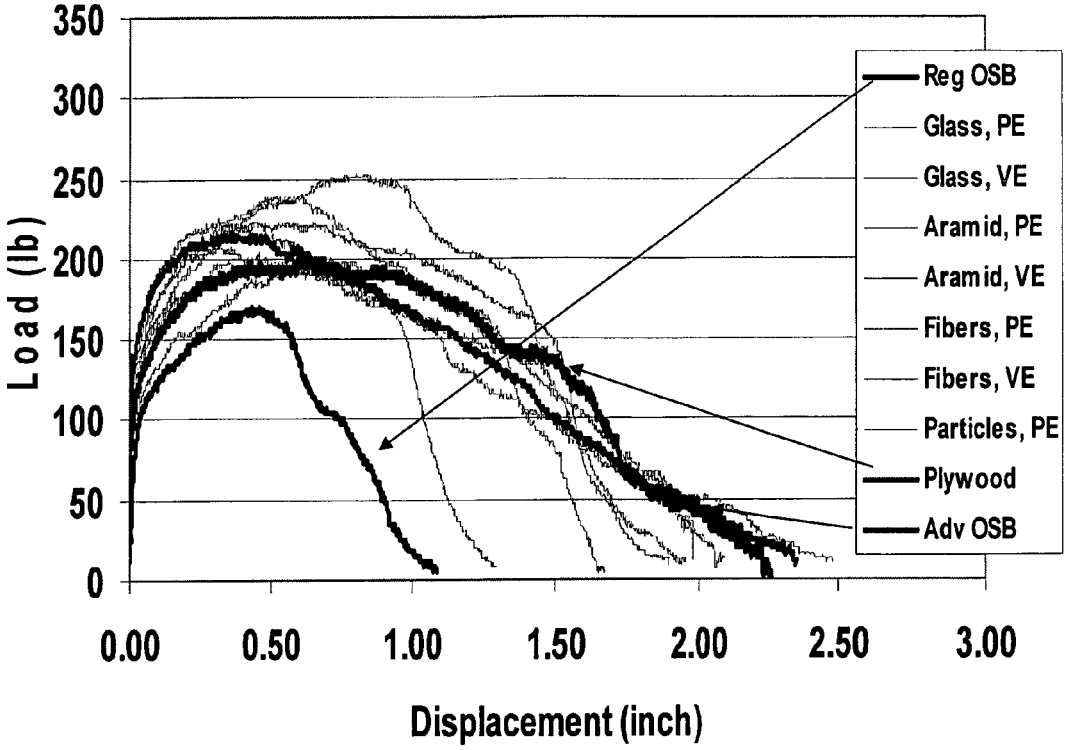
FIG. 22 is a graph showing lateral nail resistance results for wet samples (ASTM D 1761).

Un-reinforced regular OSB panels allowed a displacement of about 1 inch during loading, premium OSB (Advantec® OSB) about 1.20 inch, and the edge-reinforced panels above 1.5 inch. Reinforced OSB systems were ductile and allowed large deformations during loading. These results were obtained for the testing at ambient conditions. While about 23% lower lateral nail capacities were obtained under wet conditions, the deformations were similar to those obtained during loading at ambient conditions, as shown in FIG. 22.

Edge tear and nail/screw pull-through failures observed for un-reinforced regular OSBs were eliminated when using reinforced panels. The predominant nail failure mode for reinforced panels was nail pulling out of the framing when yielding of the nail occurred.

Figure 23:
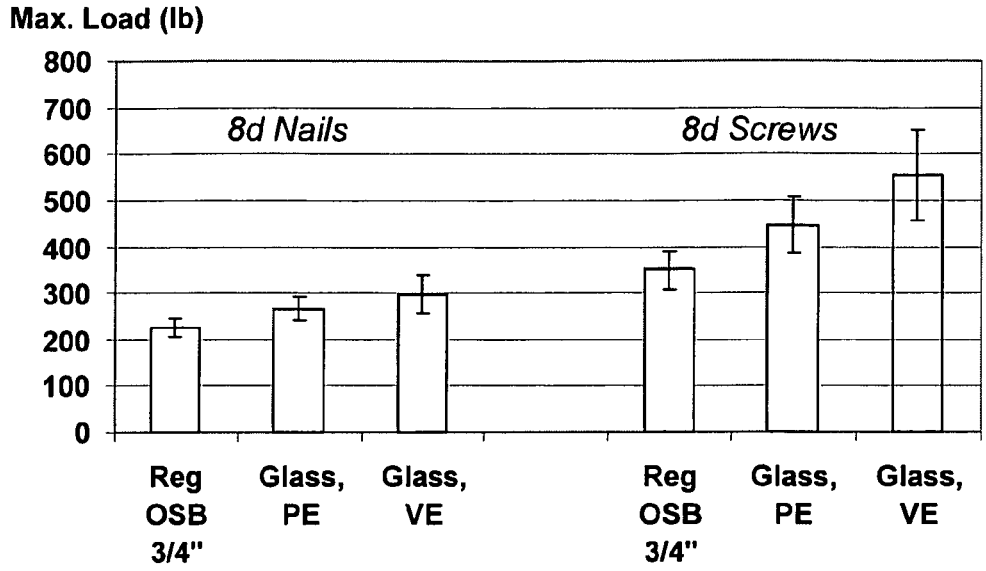
FIG. 23 is a graph showing lateral nail resistance, dry state, nails vs. screws (ASTM D 1761).

A comparison between lateral nail performance and lateral screw performance is shown in FIG. 23. Both types of fasteners, nails and screws had similar specifications. When using screws, a 55% increase in strength was observed for regular un-reinforced OSB, and 67% and 86% increase for glass-PE and glass-VE reinforced systems, respectively.

(3) Static and Cyclic Loading of Shear Walls

The main reason for running the static wall tests was to gather information required to perform the cyclic wall tests, therefore, only un-reinforced walls were tested statically. The static loading protocol shown in Table 2 is based on the lateral nail response data.

Figure 24:
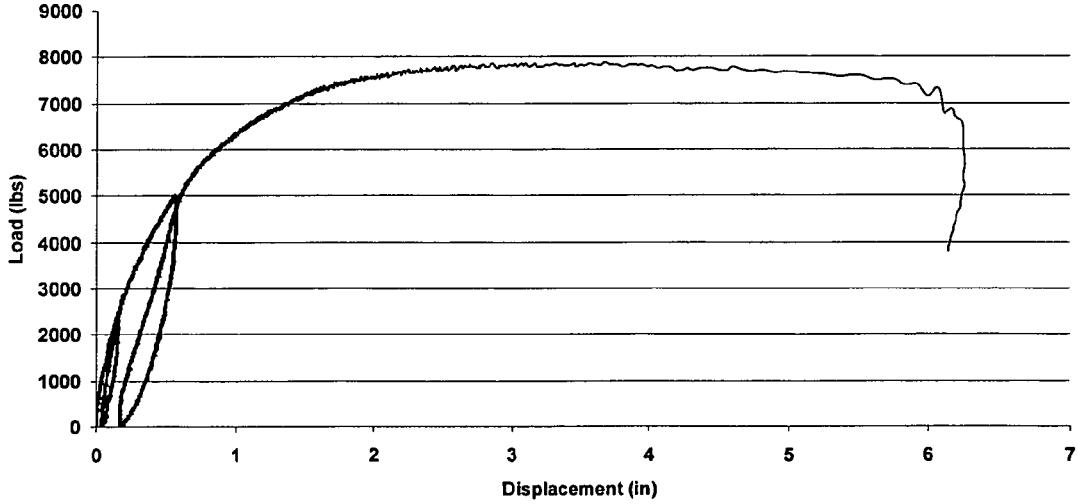
FIG. 24 is a graph showing typical loading-displacement curve for static loading (ASTM E 564).

A typical load-displacement curve for a non-reinforced two-panel shear wall is shown in FIG. 24, and the results for all three replications are listed in Table 4.

TABLE 4

Results for static loading of shear walls

| Specimen | Ultimate Load $P_{ult}$ (lb) | 80% of $P_{ult}$ $P_{(\Delta m)}$ (lb) | Monotonic Deformation Capacity (Δm) (in) | Reference Deformation Capacity Δ (in) |
|---|---|---|---|---|
| Wall 1 | 8377 | 6702 | 5.35 | 3.21 |
| Wall 2 | 9010 | 7208 | 6.20 | 3.72 |
| Wall 3 | 7883 | 6306 | 6.25 | 3.75 |
| Average | 8423 | 6706 | 5.93 | 3.56 |

These results were used for determination of the monotonic deformation capacity (Δm) and reference deformation capacity (Δ) used in the cyclic loading history protocol.

The monotonic deformation capacity (Δm) is defined as the point where the applied load drops below 80% of the peak load applied to the specimen. The average monotonic deformation capacity (Δm) is 5.93 inch. The reference deformation capacity (Δ) recommended by CUREE is 0.6 Δm. The 0.6 factor accounts for the difference in deformation capacity between monotonic and cyclic testing.

Figure 25:
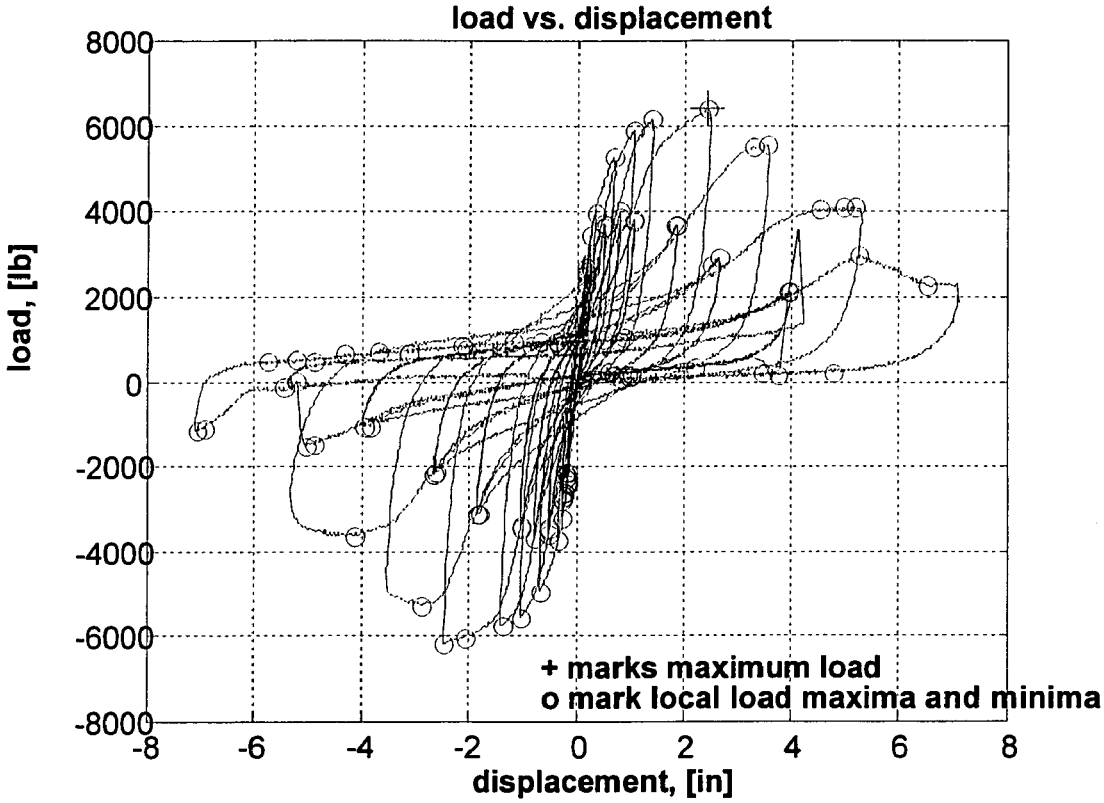
FIG. 25 is a graph showing typical loading-displacement response for cyclic loading—two-panel shear wall with regular OSB sheathing (CUREE).

Typical hysteretic response for a reinforced wall and a non-reinforced wall are shown in FIG. 25. Overall, the reinforced panels exhibited less strength and stiffness degradation as compared to un-reinforced panels. The hysteretic curves are generally symmetrical regarding loading direction, however the highest loads occurred mainly in the negative direction, when the wall was being pushed forward, and immediately after the 2 inch displacement was reached.

The maximum loads for all the static and cyclic shear wall tests are given in Table 5.

TABLE 5

Results for static and cyclic loading of shear walls

| board/reinf./matrix | connector | | | | mean | COV |
|---|---|---|---|---|---|---|
| OSB/fabric/VE | screws | 257 | 262 | — | 260 | 1.4% |
| regular plywood/— | nails | | | | 233 | 1.5% |
| OSB/powder/PE | nails | | | | 203 | 1.7% |
| regular OSB/— | nails | | | | 202 | 5.5% |
| Advantec/— | nails | | | | 196 | 10.2% |
| OSB/fabric/PE | nails | | | | 196 | 9.0% |
| OSB/powder/VE | nails | | | | 194 | 3.1% |
| OSB/fibers/PE | nails | | | | 192 | 14.3% |
| OSB/fabric/VE | nails | | | | 180 | 7.3% |
| OSB/fibers/VE | nails | | | | 170 | 12.0% |
| regular OSB/— | screws | 172 | 164 | — | 168 | 3.4% |
| regular plywood*/— | nails | 44 | 50 | 46 | 47 | 6.5% |

The "mean" values represent the averages of maximum loads for three applications. The results obtained for the reinforced systems were consistent and ranged from 6330 lb for powder-PE system to 7475 lb for fabric-VE system, as compared to 6634 lb for regular OSB, 6877 lb for Advantec® OSB, and 8610 lb for plywood. Similar to maximum loads, the total energy dissipation results were also consistent for all the walls tested, as shown in Table 6.

TABLE 6

Total energy dissipation for shear walls

| board/reinf./matrix | connector | | | | mean | COV |
|---|---|---|---|---|---|---|
| OSB/fabric/VE | screws | 150.6 | 159.1 | — | 154.9 | 3.9% |
| regular plywood/— | nails | | | | 76.3 | 4.3% |
| regular OSB/— | screws | 78.7 | 70.1 | — | 74.4 | 8.2% |
| OSB/powder/VE | nails | | | | 71.1 | 11.2% |
| regular OSB/— | nails | | | | 71.2 | 3.1% |
| OSB/fabric/VE | nails | | | | 63.2 | 5.8% |
| OSB/powder/PE | nails | | | | 68.6 | 28.0% |
| Advantec/— | nails | | | | 60.2 | 1.0% |
| OSB/fabric/PE | nails | | | | 59.6 | 5.8% |
| OSB/fibers/PE | nails | | | | 54.3 | 11.2% |
| OSB/fibers/VE | nails | | | | 52.6 | 1.4% |
| regular plywood*/— | nails | 32.0 | 25.4 | 26.4 | 27.9 | 12.7% |

The characteristic type of nail failure for the cyclic tests was nail pull out from the stud, as shown in Table 7.

TABLE 7

Nail failure mode for shear walls in cyclic loading

| System | % Nails Not Failed | % Edge Tear | % Pull Through | % Nail Fatigue | % Pull Out from Stud |
|---|---|---|---|---|---|
| Control | 4 | 4 | 1 | 24 | 66 |
| Advantec | 43 | 1 | 5 | 7 | 43 |
| PE, Powder | 34 | 11 | 1 | 8 | 39 |
| VE, Powder | 28 | 1 | 0 | 34 | 36 |
| PE, Fibers | 41 | 0 | 2 | 0 | 56 |
| VE, Fibers | 22 | 4 | 2 | 0 | 72 |
| PE, Fabric | 28 | 0 | 0 | 19 | 47 |
| VE, Fabric | 35 | 0 | 0 | 47 | 17 |

The average percentage of nail pullouts from the stud for the reinforced systems is 45%. Edge tear and nail head pull-through failures were eliminated when using reinforced panels. The higher percentage of nail pull out from framing may be attributed to the combined effect of the ¼" inch thick OSB panels used as sheathing and the 8 d smooth nails used as fasteners.

The maximum loads listed in Table 5 do not reflect the real resistance of reinforced panels. Thus, to obtain the actual reinforcement resistance, four more walls were built with 8 d exterior screws as fasteners for sheathing, two walls with un-reinforced regular OSB and two walls with fabric-VE reinforced panels.

Much higher maximum loads were obtained for the reinforced walls as compared with the un-reinforced panels when using screws, as shown in Table 5. The average maximum load for the fabric-VE system was 1,270 lb as compared to 9,968 lb for the regular OSB walls.

Although higher load carrying capacities were obtained, the walls allowed similar displacements. However, higher energy dissipation was obtained for the fabric-VE reinforced screwed panels than for any other system, as shown in Table 6.

The percentage of nail pullouts decreased substantially when using screws, as shown in Table 8.

TABLE 8

Screw failure mode for shear walls in cyclic loading

| System | % Screws Not Failed | % Edge Tear | % Pull Through | % Screw Fatigue | % Pull Out from Stud |
|---|---|---|---|---|---|
| Control | 56 | 16 | 6 | 18 | 5 |
| VE, Fabric | 72 | 0 | 6 | 20 | 2 |

The results show that edge-reinforcement is an excellent technique to improve mechanical and physical properties as well as durability of OSB panels.

The principle and mode of operation of this invention have been described in its preferred embodiments. However, it should be noted that this invention may be practiced otherwise than as specifically illustrated and described without departing from its scope.

REFERENCES CITED

American Society for Testing and Materials. 1998. Standard test methods for evaluating properties of wood-base fiber and particle panel materials. ASTM D 1037-96a, Annual Book of Standards, ASTM, West Conshohocken, Pa.

American Society for Testing and Materials. 1998. Standard Test Methods for Mechanical Fasteners in Wood. ASTM D 1761-88, Annual Book of Standards, ASTM, West Conshohocken, Pa.

American Society for Testing and Materials. 1998. Standard test method for determination of edge performance of composite wood products under surfactant accelerated moisture stress. ASTM D 2065, Annual Book of Standards, ASTM, West Conshohocken, Pa.

American Society for Testing and Materials. 1998. Standard practice for Static Load Test for Shear Resistance of Framed Walls for Buildings. ASTM E 564-95. Annual Book of Standards Vol. 4.11, ASTM, West Conshohocken, Pa.

Krawinkler, H., Parisi, F., Ibarra, L., Ayoub, A. and Medina, R, (2000). "Development of a Testing Protocol for Wood-Frame Structures." CUREE Publication No. W-02, Consortium of Universities for Research in Earthquake Engineering, Richmond, Calif.

What is claimed is:

1. An edge reinforced wood composite structural panel comprising:

a panel member having opposing major faces and a peripheral edge; and moisture impermeable reinforcement material bonded to the panel member;

wherein the moisture impermeable reinforcement material is bonded to a portion of each major face of the panel member, the portion extending along the periphery of each major face adjacent the edge and having the reinforcement material bonded thereto;

wherein the moisture impermeable reinforcement material is further bonded to the entire peripheral edge of the panel member; and wherein the moisture impermeable reinforcement material extends continuously from one major face around the edge to the opposing major face.

2. The edge reinforced wood composite structural panel according to claim 1, wherein the portion of each major face having the reinforcement material defines a perimeter zone and further defines an interior area of each major face to which no reinforcement material is bonded.

3. The edge reinforced wood composite structural panel according to claim 1, wherein the edge reinforced wood composite structural panel has a lateral fastener resistance within the range of from about 250 lbs. to about 320 lbs.

4. The edge reinforced wood composite structural panel according to claim 1, wherein the moisture impermeable reinforcement material further has a substantially U-shaped transverse cross-sectional shape.

5. The edge reinforced wood composite structural panel according to claim 1, wherein the moisture impermeable reinforcement material comprises at least one of polyester, vinyl ester, or mixtures thereof.

6. The edge reinforced wood composite structural panel according to claim 1, wherein the moisture impermeable reinforcement material comprises at least one of light woven glass fabric, light woven aramid fabric, or glass powder.

7. The edge reinforced wood composite structural panel according to claim 1, wherein the moisture impermeable reinforcement material includes one or more catalysts from the group of methyl ethyl ketone peroxide and butanone peroxide.

8. The edge reinforced wood composite structural panel according to claim 1, wherein the wood composite panel comprises an oriented strand board panel.

9. The edge reinforced wood composite structural panel according to claim 2, wherein the perimeter zone defines a surface area of the structural panel that is within the range of from about 3 percent to about 15 percent of the total surface area of any one of the major panel faces.

10. The edge reinforced wood composite structural panel according to claim 1, wherein the moisture impermeable reinforcement material comprises a fiber-to-resin weight ratio of about 15:85.

11. The edge reinforced wood composite structural panel according to claim 1, wherein the moisture impermeable reinforcement material comprises a powder-to-resin weight ratio of about 30:70.

12. The edge reinforced wood composite structural panel according to claim 1, wherein the moisture impermeable reinforcement material includes untreated fumed silica dioxide as a thixotrope agent.

13. The edge reinforced wood composite structural panel according to claim 1, wherein the moisture impermeable reinforcement material comprises chopped fibers and powder in combination with at least one of polyester and vinyl ester, or mixtures thereof.

14. The edge reinforced wood composite structural panel according to claim 1, wherein the moisture impermeable reinforcement material comprises ½ inch chopped E-glass fibers and 1/32 inch milled E-glass powder in combination with at least one of polyester and vinyl ester, or mixtures thereof.

15. The edge reinforced wood composite structural panel according to claim 1, wherein the moisture impermeable reinforcement material is impregnated into the panel member.

16. An edge reinforced wood composite structural panel comprising:

a panel member having opposing major faces and a peripheral edge; and moisture impermeable reinforcement material bonded to the panel member;

wherein the moisture impermeable reinforcement material is bonded to a portion of each major face of the panel member, the portion extending along the periphery of each major face adjacent the edge and having the reinforcement material bonded thereto;

wherein the moisture impermeable reinforcement material is further bonded to the entire peripheral edge of the panel member; and wherein the edge reinforced wood composite structural panel has a lateral fastener resistance within the range of from about 250 lbs. to about 320 lbs.

* * * * *